United States Patent [19]

Schneider et al.

[11] Patent Number: 4,598,902

[45] Date of Patent: Jul. 8, 1986

[54] APPARATUS FOR SEPARATING LATERALLY PROJECTING IMBRICATED PRINTED COPY PRODUCTS

[75] Inventors: Eckhard Schneider, Stadtbergen; Walter Purkl, Augsburg, both of Fed. Rep. of Germany

[73] Assignee: M.A.N.-Roland Druckmaschinen Aktiengesellschaft, Offenbach am Main, Fed. Rep. of Germany

[21] Appl. No.: 686,209

[22] Filed: Dec. 26, 1984

[30] Foreign Application Priority Data

Jan. 11, 1984 [DE] Fed. Rep. of Germany ..... 3400639

[51] Int. Cl.[4] ..... B65H 29/04

[52] U.S. Cl. ..... 271/205; 198/436; 198/461; 226/173; 270/52; 271/198; 271/277

[58] Field of Search ..... 271/204, 205, 206, 277, 271/198; 198/440, 436, 461; 270/54, 55, 56, 57, 52; 226/170, 172, 173

[56] References Cited

U.S. PATENT DOCUMENTS 3,056,535 10/1962 Baugh et al. ..... 226/172
3,635,322 1/1972 Raudat et al. ..... 198/440
4,118,025 10/1978 Konars et al. ..... 271/273

FOREIGN PATENT DOCUMENTS 1153383 8/1963 Fed. Rep. of Germany .
3212350 10/1983 Fed. Rep. of Germany .

*Primary Examiner*—Bruce H. Stoner, Jr.
*Assistant Examiner*—John A. Carroll
*Attorney, Agent, or Firm*—Frishauf, Holtz, Goodman & Woodward

[57] ABSTRACT

To pull apart interfolded, imbricated paper copy products (4, 5), two pairs (1, 2) of upper and lower transport systems, typically sprocket chains, each have engagement projection elements (10–13), preferably roller elements, extending therefrom, and gripping laterally projecting edges of the respective imbricated in-folded copy products. The paths of the upper and lower transport systems (6–7, 8–9) converge towards each other to grip the copy products and, after having gripped the copy products, the pairs diverge laterally from each other to pull out and pull apart the copy products (4', 5') gripped by the respective pairs of the transport systems, the upper and lower transport systems then diverging to release the copy products to further removal transport arrangements, for example transport belts (17, 18).

19 Claims, 3 Drawing Figures

APPARATUS FOR SEPARATING LATERALLY PROJECTING IMBRICATED PRINTED COPY PRODUCTS

The present invention relates to an apparatus to separate imbricated printed copy products, and more particularly to an apparatus in which folded copy products are to be separated, the copy products forming the outer ones of the folded products being laterally offset from the inner ones, so that the outer and inner copy products can be gripped separately for subsequent placement into individual separated transport paths.

BACKGROUND

It has previously been proposed—see the referenced German Patent No. 11 53 383—to remove sheet-like products received from a rotary printing machine by gripping the products on grippers secured to a chain, and passing the products into respective transport paths. Such apparatus requires complex controls for the grippers for timed opening and closing of the grippers, that is, to pinch and release the respective products. Control apparatus of this type, particularly when operating at high speed, can be costly and are subject to malfunction. It has also been proposed—see the German Patent Disclosure Document DE-OS 32 12 350—to utilize upper and lower pick-up tapes or belts running along the sides of imbricated copy products. The copy products which are to be separated from each other, that is, pulled out from each other laterally, are gripped by the respective bands or belts. It is not possible, however, to positively and reliably grip these copy products in that manner and to guide them into the respective transport path with proper alignment and orientation so that a predetermined register with respect to a reference can be maintained.

THE INVENTION

It is an object to separate imbricated or folded-in copy products from each other which permits accurate removal of inner copy products from outer ones and reliable gripping of the respective copy products for separation without, however, requiring complex control systems or apparatus.

Briefly, two pairs of upper and lower transport systems are provided. Each pair of the upper and lower transport systems includes an upper and lower endless transport elements, for example an endless chain, from which a plurality of engagement projections extend. The endless chains, belts, or cables are guided first parallel to the respective edges of the copy products but spaced from each other; then, the upper and lower transport systems are converged towards each other so that the projecting elements will grip the edges of the laterally projecting copy products. With the upper and lower transport systems then in sheet-engaging positions, the pairs are diverged from each other, that is, from the direction of the prior transport of the copy products, so that the respectively gripped copy products are pulled laterally apart. When the respective copy products have reached their own transport paths, the upper and lower transport systems forming the pairs are then separated again to release the respective copy products, for further transport in their respective paths. Preferably, the two pairs operate at different speeds, for example the pair of upper and lower transport systems which grip the outer one of the copy products operates slightly faster than the other to provide for reliable separation.

DRAWINGS

DETAILED DESCRIPTION

Figure 1:
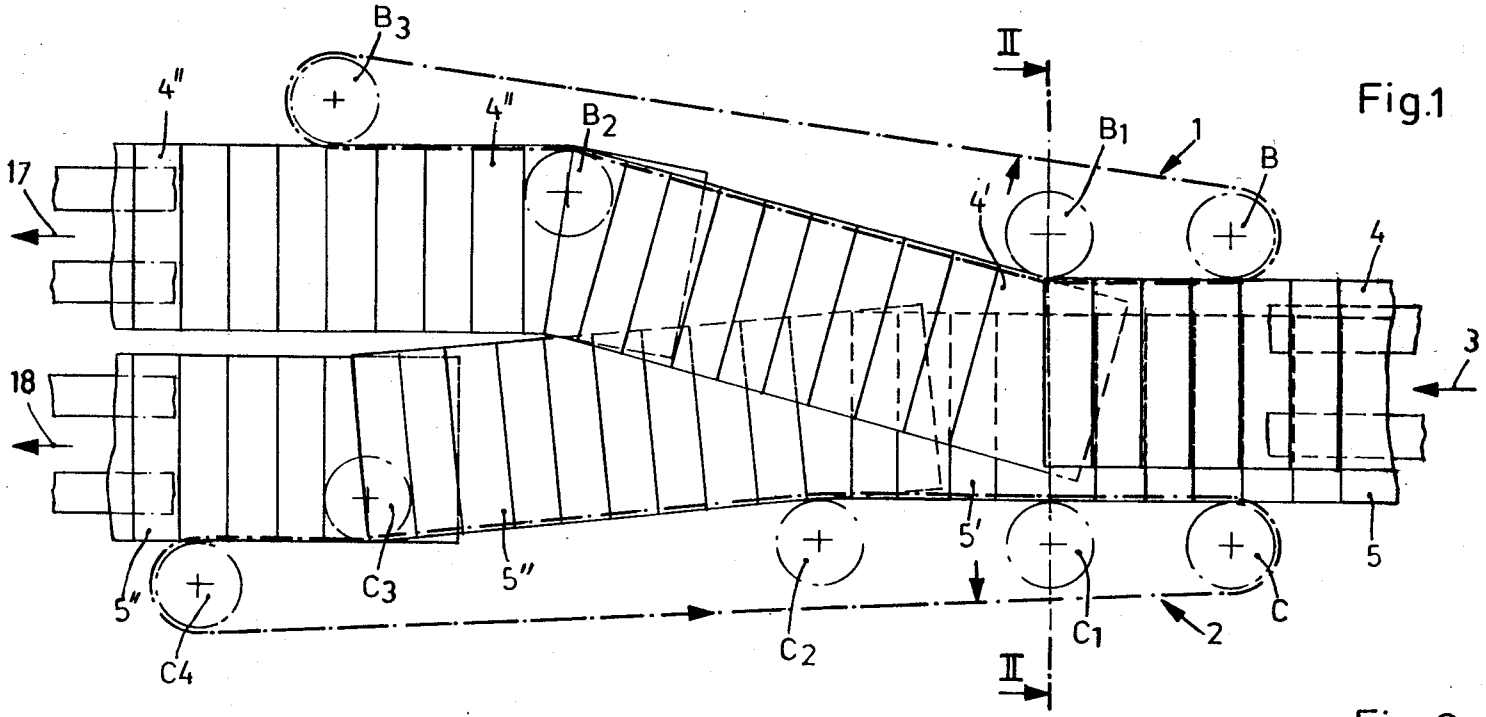
FIG. 1 is a schematic top view of the apparatus.

Two pairs of transport systems, 1 and 2, are located on respective sides of the printed copy. The printed copy, illustrated as folded sheets 4, 5, is supplied by an incoming or supply transport system in the direction of the arrow 3, for example by a pair of belts. The copy products are imbricated, that is, are folded within each other. As can be seen, the copy product 4 is folded within a copy product 5. Copy product 4 thus forms an inner copy product. It projects laterally from the outer copy product 5. Such lateral offset of inner and outer copy products can be easily obtained by passing a longitudinally cut endless web by suitable arrangement of turning apparatus or turning bars such that, when the copy products are joined, they will be laterally offset from each other. After suitable cross-cutting and folding, the folded copy products 4, 5 will be obtained.

The present invention is not directed to the generation of such offset folded copy products; rather, the present invention is directed to separate the folded copy products which are folded within each other in such a manner that the inner copy products—of which there may be a number—which projects from one side are separated from the outer copy products—of which again there may be a number of sheets—which project from the other side.

Figure 2:
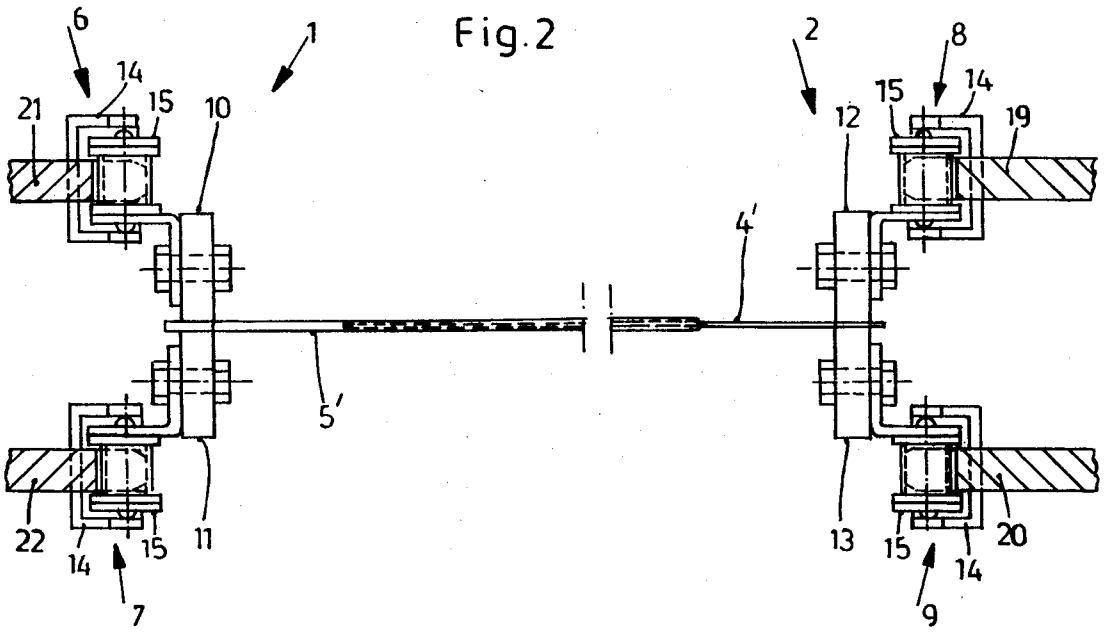
FIG. 2 is a part-sectional view along line II—II of FIG. 1, and omitting all material not necessary for an understanding of the invention.

In accordance with the present invention, two elongated, endless transport systems 6, 7; 8, 9, in pairs, are located adjacent the supply transport path 3. The elongated endless transport systems may be formed as cables, belts, or, preferably, sprocket chains. As best seen in FIG. 2, the chains 6, 7, 8, 9 have a plurality of engagement projections 10, 11, 12, 13 secured thereto such that the engaging projections extend towards each other. The respective sprockets or chain elements 15, thus, carry the engagement projections which may be plungers, spring-loaded pins, or, preferably, roller elements rotatable, for example, about a shaft or bolt as shown in FIG. 2. Only one of the roller elements—and not shown in section—is illustrated in FIG. 2 for simplicity.

The endless transport systems 6, 7; 8, 9 of each pair are so guided that the upper and lower—with respect to FIG. 2—roller systems are separated, or spread apart from each other at an initial or receiving position B, C (see FIG. 1) leaving a clearance space. The transport systems are guided in their respective paths towards each other by guide rails 14. The transport chains are returned, guided above each other, by suitable sheaves, not shown in the drawings for simplicity, and which may be of any well known construction.

Figure 3:
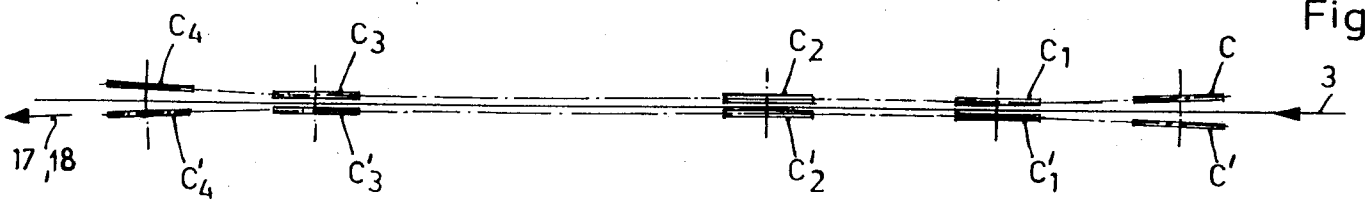
FIG. 3 is a fragmentary side view of the transport system pair of the left side of FIG. 1, in part-schematic representation.

The spacing of the projection elements 10–13 in the region B, thus, is such that the copy products 4, 5 can easily pass between spaced engagement projections. The links 15 of the sprocket chains 10–13 are guided in lateral paths by guide elements, preferably guide wheels 19–22 which, also, control the longitudinal movement of the respective sprocket chains. The pairs of the transport systems are so placed that the inner copy product, for example copy product 4, will be gripped by the projections 12, 13, while the outer copy product 5 will be gripped by the projections 10, 11 of the pair 1 of the transport systems. The initial gripping station between the regions B, C (FIG. 1) may be so arranged that the chains 6, 8 are placed at an inclination with respect to the chains 7, 9—as best seen in FIG. 3, positions C, C'. The path of the transport systems 6, 7; 8, 9 extends essentially parallel to the supply path 3 for some distance. In the region B1, C1, the chains 6, 7; 8, 9 are then converged towards each other by suitable arrangement of guide wheels or the guide track 14 such that the engagement projection elements 10, 11, 12, 13 grip the respective copy products 5', 4' between themselves. A plurality of such projection elements are provided, preferably located closely spaced from each other, so that the copy products 4', 5' will be gripped by two or more longitudinally staggered engagement projection elements 10, 11, 12, 13, to be clamped and gripped between the respective opposing projection elements.

After the copy products 4', 5' are gripped, the direction of the paths of the pairs 1, 2 is changed—see FIG. 1—in that the path of the system 1 diverges laterally from the path of the system 2. The respective angles of divergence, and the particular arrangement of divergence, is not critical. Preferably, the pairs of transport systems are driven at different speeds; for example, the pairs 6, 7 which grip the outer copy products are driven at a speed which is higher than the speed of the transport systems 8, 9 which grip the inner copy products 4. The paths, diverging as seen in the sections B2, B3, are then, additionally, diverged vertically from each other, to separate the upper and lower engagement projection elements from each other. The copy products, now shown at 4'', 5'' are released from engagement with the engagement projection elements. This is obtained automatically by inclined guidance of the sprockets 6, 8 upwardly, for example—see FIG. 3, positions C3, C'3 and C4, C'4. The copy products are thus separated in separate paths 17, 18, from which they can be removed by separate belt transport systems in accordance with any well known and suitable construction. The sprocket chains are endless and are returned over suitable return sheaves, not shown in the drawings, for simplicity. These sheaves would be placed at right angles with respect to the plane of FIG. 1, for example. The engagement projection elements 10, 11 and 12, 13 are then return by the return run of the respective transport system 6, 8, 7, 9 to the inlet positions B, C to receive new folded copy products.

The guide tracks 14, shown in FIG. 2, for the upper and lower guidance of the sprocket chains, are not strictly necessary but preferably used. In combination with the drive sprockets 19–22 they so guide the transport systems formed by the sprocket chain that the spacing of the respective sprocket chains is such that any copy products which come between the engagement projection elements will be securely clamped even if the respective engagement projection elements are not positioned opposite each other. Thus, roller elements 10–13 can be so placed that, for example, a circumferential zone of an upper roller, for example roller 10, can fit between two circumferential zones of two lower rollers 11, thus clamping the copy products 5' therebetween. Preferably, the suspension of the engagement projection elements is resilient, or the guide path 14 and the respective sprockets 19–21 are resiliently supported to permit gentle engagement of copy products between the respective engagement projection elements.

FIG. 3 illustrates, only schematically, the position of the respective upper and lower engagement projections in regions C to C4 and C' to C'4. Only the sprocket wheels 19–21 are shown, highly schematically, to illustrate the inventive concept. Various changes and modifications may be made within the scope of the invention.

We claim:

1. Apparatus for separating imbricated printed copy products (4, 5) having a first arriving transport path (3) feeding said copy products in which outer imbricated copy products (5) are offset laterally from inner copy products (4) folded in the outer copy products (5), comprising two pairs (1, 2) of upper (6, 8) and lower (7, 9) transport systems, one pair each being located at the side of the transport path (3) and each pair engaging a respective side of the folded copy products and hence either an outer (5) or an inner (4) copy product;

each upper and lower transport system (6–7; 8–9) including an endless transport element and a plurality of engagement projection elements (10, 11, 12, 13) positioned on the respective upper and lower transport systems to project towards each other;

and guide means (14; 19, 20, 21, 22) guiding the respective pairs of transport elements in paths in which (a) the pairs (1, 2) are essentially parallel to said transport path (3) and the upper and lower systems are positioned to leave an open clearance space between the projection elements (B; C, C1);

(b) the pairs (1, 2) of the transport systems continue in a path essentially parallel to said transport path (3) and the upper and lower systems of the pairs close towards each other to place and grip the lateral projecting portions of the copy products (4', 5') between said projection elements (B1; C1, C2);

(c) the pairs (1, 2), with the gripped projecting portions of the copy products therebetween, diverge laterally from each other to thereby pull the inner and outer printed copy products apart and out from each other (C2, C'2) until the copy products (4', 5'), gripped between the projection elements (10–13) are clear of each other (B2; C3, C'3); and (d) the upper and lower systems spread apart to release the copy products (4'', 5'') from gripping engagement by said projection elements (C4, C'4).

2. Apparatus according to claim 1, wherein the projection elements (10–13) comprise resiliently supported elements.

3. Apparatus according to claim 1, wherein the projection elements (10–13) comprise rotatable elements.

4. Apparatus according to claim 1, wherein the projection elements (10–13) comprise roller elements.

5. Apparatus according to claim 1, wherein the upper and lower transport systems (6–7; 8–9) are positioned at an inclination with respect to each other in the regions (a) and (d) of said paths.

6. Apparatus according to claim 1, wherein the transport systems comprise sprocket chain systems, the projection element being secured to said sprocket chain systems.

7. Apparatus according to claim 1, wherein one pair (1) of transport systems (6, 7) is operated at a speed which differs from the speed of the other pair (2) of transport systems (8, 9).

8. Apparatus according to claim 7, wherein the transport system (1) engaging the outer copy products (5) is operated at a speed which is higher than the speed of the other pair (2) of the transport system (8, 9) and engaging the inner copy products (4).

9. Apparatus according to claim 1, wherein the guide means include guide rails (14) located at least in the region (a) of said paths.

10. Apparatus according to claim 1, wherein the engagement projection elements (10–13) are closely spaced longitudinally on the respective transport elements to provide for gripping of any copy product by at least two longitudinally staggered projection elements.

11. Apparatus according to claim 10, wherein the projection elements (10–13) comprise resiliently supported elements.

12. Apparatus according to claim 10, wherein the projection elements (10–13) comprise roller elements.

13. Apparatus according to claim 10, wherein the upper and lower transport systems (6–7; 8–9) are positioned at an inclination with respect to each other in an entrance region and an exit region of said paths.

14. Apparatus according to claim 10, wherein the transport systems comprise sprocket chain systems, the projection element being secured to said sprocket chain systems.

15. Apparatus according to claim 14, wherein the transport system (1) engaging the outer copy products (5) is operated at a speed which is higher than the speed of the other pair (2) of the transport system (8, 9) and engaging the inner copy products (4).

16. Apparatus according to claim 10, wherein one pair (1) of transport systems (6, 7) is operated at a speed which differs from the speed of the other pair (2) of transport systems (8, 9).

17. Apparatus according to claim 10, wherein the guide means include guide rails (14) located at least in the region (a) of said paths.

18. Apparatus for separating imbricated printed copy products (4, 5) having a first arriving transport path (3) feeding said copy products in which outer imbricated copy products (5) are offset laterally from inner copy products (4) folded in the outer copy products (5), and comprising, in accordance with the invention, two pairs (1, 2) of upper (6, 8) and lower (7, 9) transport systems, one pair each being located at the side of the transport path (3) and each pair engaging a respective side of the folded copy products and hence either an outer (5) or an inner (4) copy product;

each upper and lower transport system (6–7; 8–9) including an endless transport element and a plurality of rotatable engagement projection elements (10, 11, 12, 13) positioned on the respective upper and lower transport systems to project towards each other;

and guide means (14; 19, 20, 21, 22) guiding the respective pairs of transport elements in paths in which (a) the pairs (1, 2) are essentially parallel to said transport path (3) and the upper and lower systems are positioned to leave a clearance between the projection elements (B; C, C1);

(b) the upper and lower systems converge to guide the lateral projecting portions of the copy products (4', 5') between said projection elements (B1; C1, C2);

(c) the pairs (1, 2) diverge laterally from each other to thereby pull the inner and outer printed copy products apart and out from each other (C2, C'2) until the copy products (4', 5'), gripped between the projection elements (10–13) are clear of each other (B2; C3, C'3); and (d) the upper and lower systems diverge to release the copy products (4'', 5'') from gripping engagement by said projection elements (C4, C'4).

19. Apparatus according to claim 18, wherein the engagement projection elements (10–13) are closely spaced longitudinally on the respective transport elements to provide for gripping of any copy product by at least two longitudinally staggered projection elements.

* * * * *